US006843232B2

(12) United States Patent
Keesee et al.

(10) Patent No.: US 6,843,232 B2
(45) Date of Patent: Jan. 18, 2005

(54) POSITIVE STOP DIAPHRAGM ASSEMBLY FOR FUEL PRESSURE REGULATOR

(75) Inventors: Michael Keesee, Williamsburg, VA (US); Jan L. Bennett, Williamsburg, VA (US); Robert Jackson, Hampton, VA (US)

(73) Assignee: Siemens VDO Automotive Corp., Auburn Hills, MI (US)

( * ) Notice: Subject to any disclaimer, the term of this patent is extended or adjusted under 35 U.S.C. 154(b) by 0 days.

(21) Appl. No.: 10/180,491

(22) Filed: Jun. 27, 2002

(65) Prior Publication Data

US 2004/0000293 A1 Jan. 1, 2004

(51) Int. Cl.[7] ..... F02M 41/00
(52) U.S. Cl. ..... 123/463; 123/457; 137/510
(58) Field of Search ..... 123/463, 457, 123/447, 456, 514; 137/510, 271, 509

(56) References Cited

U.S. PATENT DOCUMENTS

| | | | | |
|---|---|---|---|---|
| 4,205,637 A | | 6/1980 | Ito et al. | 123/32 AE |
| 4,237,924 A | * | 12/1980 | Benjamin et al. | 137/510 |
| 4,635,537 A | | 1/1987 | Field | 92/98 R |
| 4,742,845 A | | 5/1988 | Capoccia et al. | 137/510 |
| 4,756,289 A | | 7/1988 | Rock et al. | 123/463 |
| 4,909,278 A | | 3/1990 | Ray | 137/505.12 |
| 5,065,725 A | | 11/1991 | Spoetter | 123/463 |
| 5,275,203 A | * | 1/1994 | Robinson | 123/463 |
| 5,609,138 A | | 3/1997 | Mutschler | 123/463 |
| 5,647,330 A | | 7/1997 | Sawert et al. | 123/509 |
| 5,673,670 A | * | 10/1997 | Powell et al. | 123/463 |
| 5,794,597 A | * | 8/1998 | Schwegler | 123/463 |
| 6,298,828 B1 | * | 10/2001 | Concialdi | 123/457 |
| 6,422,265 B1 | * | 7/2002 | Beyer et al. | 123/463 |

* cited by examiner

*Primary Examiner*—Carl S. Miller

(57) ABSTRACT

A fuel pressure regulator for use with an internal combustion engine includes a housing, a valve assembly in the housing, an elastic diaphragm connecting the valve assembly to the housing, a stop on one of the housing and the support and a spring between the housing and the valve assembly. The housing includes an inlet, an outlet and a longitudinal axis. The valve assembly is intermediate the inlet and the outlet and selectively opens fluid communication between the inlet to the outlet when a fuel pressure at the inlet is at least equal to an over-pressure amount. The valve assembly is displaceable along the longitudinal axis by an opening distance when a fuel pressure at least equal the over-pressure amount acts on the diaphragm so that the diaphragm does not exceed its yield strength. The diaphragm is in fluid communication with the inlet and elastically displaceable along the longitudinal axis up to a maximum distance. The stop is spaced from the other of the housing and the support along the longitudinal axis by a traveling distance when the valve assembly closes the fluid communication between the inlet and the outlet. The traveling distance is at most equal to the maximum distance and substantially greater than the opening distance. The spring biases the valve assembly to close the fluid communication between the inlet and the outlet when the fuel pressure at the inlet is less than the over-pressure amount.

16 Claims, 2 Drawing Sheets

POSITIVE STOP DIAPHRAGM ASSEMBLY FOR FUEL PRESSURE REGULATOR

BACKGROUND OF THE INVENTION

It is believed that fuel pressure regulators relieve over-pressures in the fuel supply line extending between the fuel tank and the internal combustion engine. This fuel pressure regulation maintains the fuel pressure supplied to the fuel injectors at or below a prescribed value.

It is believed that over-pressures in the fuel supply line are caused by at least two sources. The first source includes fuel pressure pulses generated by the fuel pump sending pressurized fuel from the fuel tank to the fuel injectors. The second source includes unintended restrictions in the fuel supply line such as crimps or debris blockages.

SUMMARY OF THE INVENTION

There is provided a fuel pressure regulator for use with an internal combustion engine, the fuel pressure regulator includes a housing, a valve assembly in the housing and an elastic diaphragm connecting the valve assembly to the housing. The housing includes an inlet, an outlet and a longitudinal axis and has a total length measured along the longitudinal axis of approximately 30–40 mm. The valve assembly is intermediate the inlet and the outlet and selectively opens fluid communication between the inlet and the outlet when a fuel pressure at the inlet is at least equal to 500 kPa.

There is also provided a fuel pressure regulator for use with an internal combustion engine, the fuel pressure regulator includes a housing, a valve assembly in the housing, an elastic diaphragm connecting the valve assembly to the housing, a stop on one of the housing and the support and a spring between the housing and the valve assembly. The housing includes an inlet, an outlet and a longitudinal axis. The valve assembly is intermediate the inlet and the outlet and selectively opens fluid communication between the inlet to the outlet when a fuel pressure at the inlet is at least equal to an over-pressure amount. The valve assembly is displaceable along the longitudinal axis by an opening distance when a fuel pressure at least equal the over-pressure amount acts on the diaphragm so that the diaphragm does not exceed its yield strength. The diaphragm is in fluid communication with the inlet and elastically displaceable along the longitudinal axis up to a maximum distance. The stop is spaced from the other of the housing and the support along the longitudinal axis by a traveling distance when the valve assembly closes the fluid communication between the inlet and the outlet. The traveling distance is at most equal to the maximum distance and substantially greater than the opening distance. The spring biases the valve assembly to close the fluid communication between the inlet and the outlet when the fuel pressure at the inlet is less than the over-pressure amount.

There is yet also provided a method of assembling a fuel pressure regulator for use with an internal combustion engine, the method includes providing a housing, a valve seat intermediate the inlet and the outlet, a support movable inside the housing, a closure member connected to the support, a diaphragm attached to the support and to the housing, a stop on one of the housing and the support, and a spring adjacent the stop. The housing includes an inlet and an outlet. The valve seat fluidly connects the inlet to the outlet. The closure member is matingly engageable with the valve seat to shut off the fluid connection between the inlet and the outlet provided by the valve seat. The diaphragm is resiliently displaceable up to a maximum distance. The spring biases the valve into mating engagement with the valve seat and permitting the closure member to separate from the valve seat by an opening distance to fluidly connect the inlet and the outlet. The stop is engageable with the other of the housing and the support. Each of the housing, the outlet, the spring and the stop is provided with a length tolerance. The method also includes spacing the stop from the housing by a traveling distance that is approximately equal to the sum of the length tolerances of the housing, the outlet, the compression spring and the stop.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENT

Figure 1:
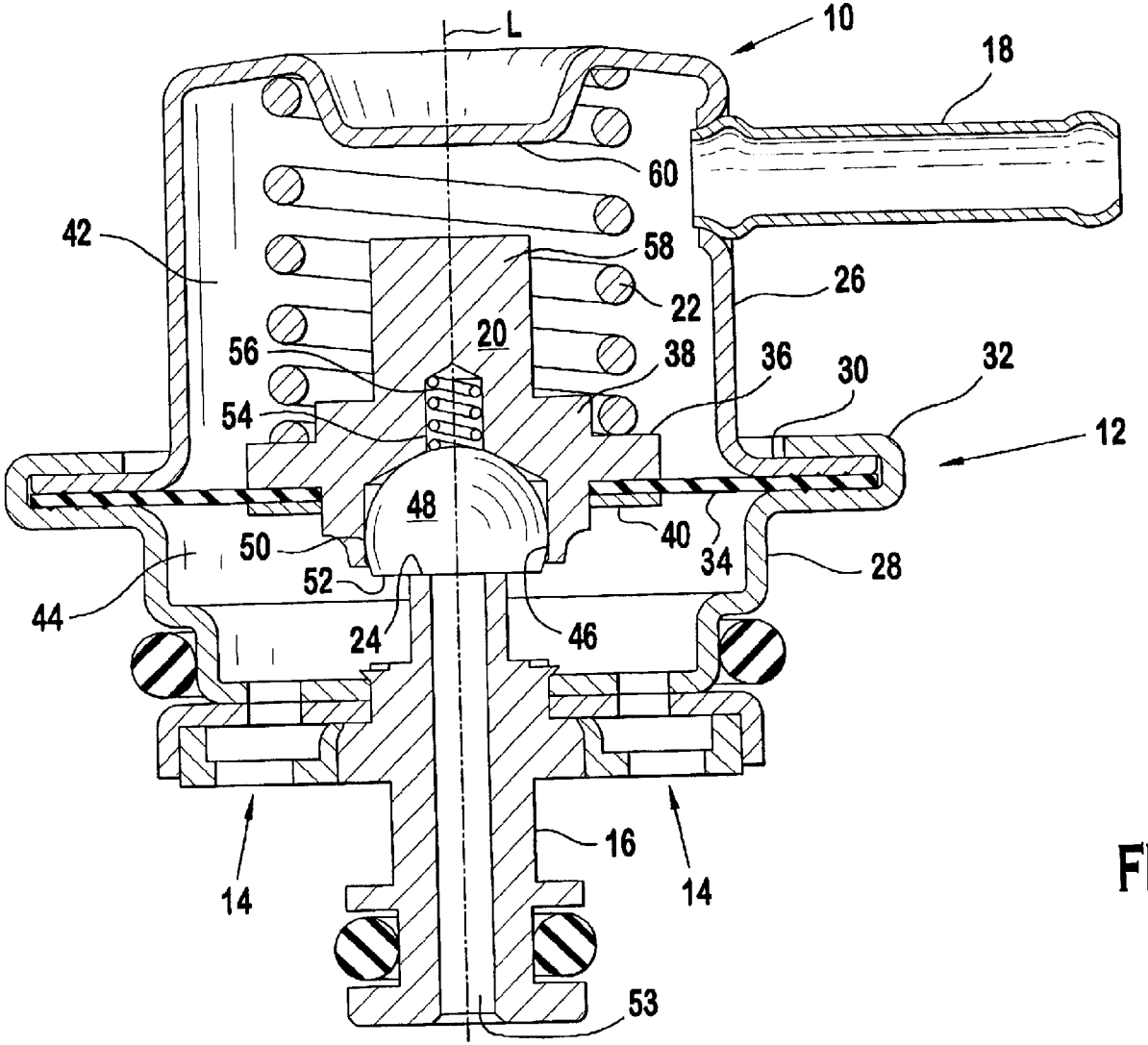
FIG. 1 is a cross-sectional view of a fuel pressure regulator according to the invention in with the valve closed.

A fuel pressure regulator 10 includes a housing 12 having a plurality of fuel inlets 14, a fuel outlet 16, and a reference pressure inlet 18. The housing 12 contains a diaphragm assembly 20 biased by a spring 22 into sealing engagement with a valve seat 24 to block the flow of fuel from the fuel inlets 14 to the fuel outlet 16. Fuel entering the fuel inlets 14 applies a pressure to diaphragm assembly 20. As explained in detail below, if the fuel pressure exceeds a predetermined value, the diaphragm assembly 20 lifts off the valve seat 24, against the bias of the spring 22, to open the fuel outlet 16.

The spring 22 determines the over-pressure value at which of the fuel pressure regulator 10 operates. This permits a modular design for the regulator 10 in which the spring 22 is the only part of the fuel pressure regulator 10 that needs to be altered to meet different operating parameters. In the preferred embodiment, the spring rates in the range of 6.9–15 N/m can be interchanged during manufacture of a family of fuel pressure regulators 10 employing a diaphragm having an operating area of approximately 0.30–0.50 $in^2$, a thickness of approximately 0.23–0.45 mm and a yield strength of at least approximately 150 psi. This preferred embodiment approach provides a family of fuel pressure regulators 10 having different pressure control values. The diaphragm 34 can be made from rubber or other elastic material sufficient to withstand the chemical effects of the fuel and provide the requisite elasticity, such as nitrile, florocarbon rubber and florosilicon rubber. This reduces manufacturing inventory, assembly complexity and cost.

The housing includes a can housing member 26 connected to a lower housing member 28. The can housing member 26 includes a radial flange 30 and the lower housing member 28 includes a crimping flange 32. The total length $D_h$ (FIG. 2) of the housing 12 as measured along the longitudinal axis L (FIG. 1) is 30–40 mm, and in the preferred embodiment approximately 22 mm.

The diaphragm assembly 20 includes a flexible annular diaphragm 34 having an outer portion crimped between the radial flange 30 and the crimping flange 32 to secure the diaphragm assembly 20 to the housing 12. The inner portion of the diaphragm 34 is crimped between a radial flange 36 of a support member 38 and a retainer plate 40 to secure the diaphragm 34 to the support member 38. The diaphragm assembly 20 divides the housing 12 into an upper chamber 42 and a lower chamber 44. The volume of the lower chamber 44 is approximately 1100 $mm^3$.

The support member 38 includes a recess 46 that receives a valve closing member 48. The valve closing member 48 has a spherical outer surface 50 that permits the valve closing member 48 to rotate within the recess 46 and a flat face 52 that mates with the valve seat 24 to seal off the fuel passage 53 of the fuel outlet 16. The support member 38 includes a bore 54 centered on the recess 46. The bore 54 contains a spring 56 that biasingly engages the spherical outer surface 50 of the valve closing member 48. The interaction of the spherical outer surface 50 of the ball member 48 with the recess 46 and the spring 56 ensures that the flat face 52 of the valve closing member 48 is properly aligned with the valve seat 24 to fluidly seal the fuel passage 53.

Figure 2:
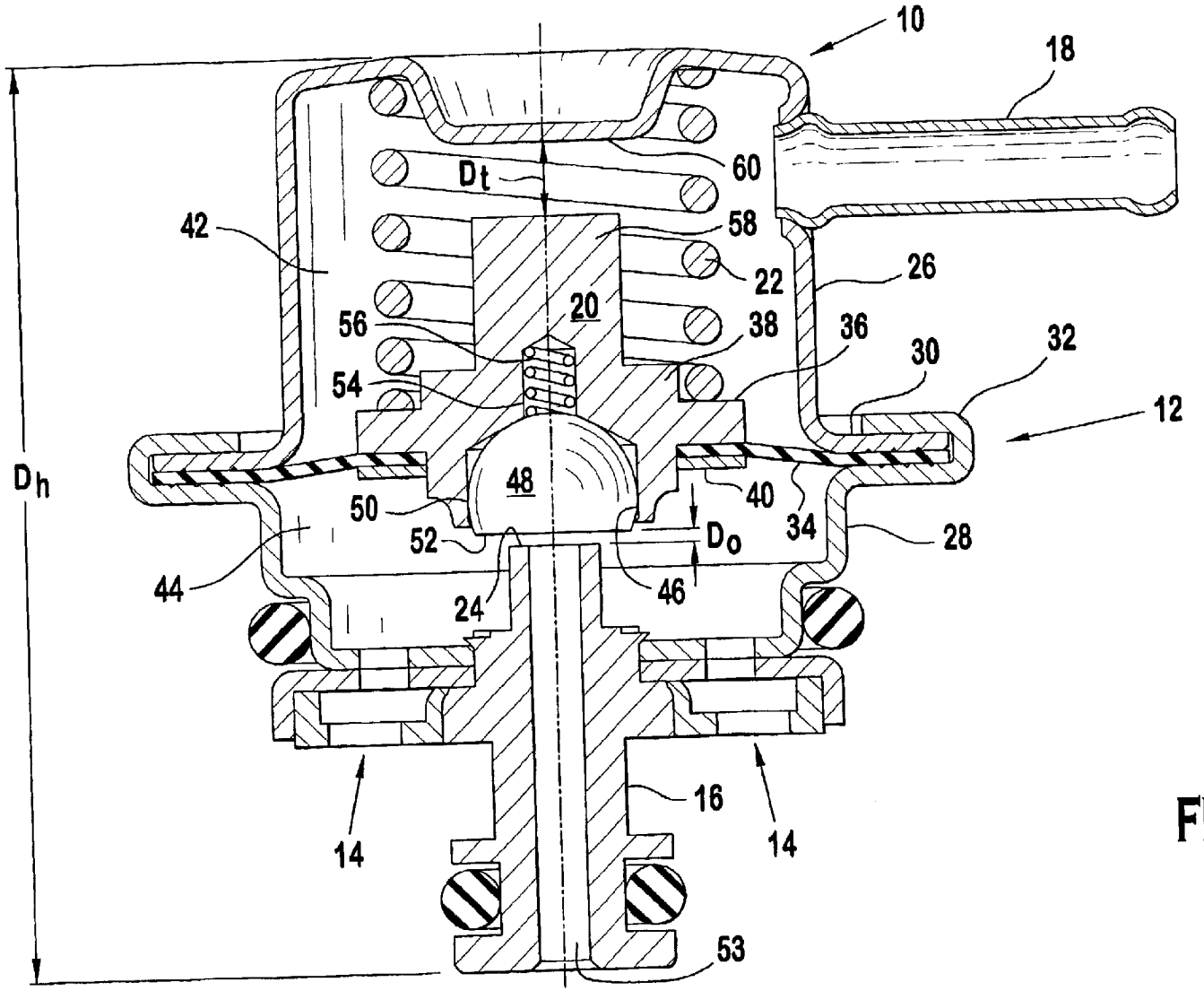
FIG. 2 is a cross-sectional view of a fuel pressure regulator according to the invention with the valve opened.

Fuel in the supply path (not shown) enters the regulator 10 through the fuel inlet 14 and applies a pressure against the diaphragm 34. When this applied pressure exceeds a predetermined value, called over-pressure, the diaphragm 34 resiliently deflects toward the can housing member 26 to raise valve closing member 48 off the valve seat 24 as shown in FIG. 2. Fuel can then escape the supply path through the fuel passage 53, thus lowering the fuel pressure in the supply path into the requisite operating pressure range. Thus, the pressure regulator 10 prevents over-pressurized fuel from reaching the outlet of the supply path.

It is believed that, generally, the yield strength of the diaphragm 34 of known pressure regulators is exceeded only under rare over-pressure conditions. This is because the over-pressure in all but these rare over-pressures is sufficiently reduced below the yield strength of the diaphragm when the valve closing member 48 opens the fuel passage 53 to permit excess fuel to escape the supply path.

It is believed that the trend in fuel injection systems is an increased operating fuel pressure. It is believed that these operating pressures are in excess of 500 kPa with over-pressures in excess of approximately 800 kPa. This trend creates a conflict with conventional pressure regulators, in which it is believed that the diaphragm material cannot be substantially altered in material or thickness to resist material failure under these higher operating pressures and the possible associated over-pressures while simultaneously providing the over-pressure regulation of the fuel in the supply path. That is, it is not possible to accommodate these higher pressures experienced by the diaphragm by simply increasing the thickness of the diaphragm or using a stronger material. Such countermeasures have adverse effects on the proper performance of the diaphragm when the extreme conditions do not exist.

It is believed that the permissible distance that the diaphragm 34 can be displaced exceeds the resilient elongation of the diaphragm. It is also believed that it is not permissible to increase the crimp force of the crimping flange 32 to secure the diaphragm 34 to the housing 12 without causing a material failure of the diaphragm 34 at the crimp. As a result, high over-pressure could cause the diaphragm 34 to exceed its yield strength and tear away from the crimping flange 32. The over-pressure at which the diaphragm fails is called the burst pressure.

In order to combat this failure mode, a stop 58 extends from the support member 38 toward the roof 60 of the can housing member 26. The stop 58 is spaced from the roof 60 by an traveling distance $D_t$ that is less than the elongation of the diaphragm 34 that would cause the diaphragm 34 to exceed its yield strength. When the diaphragm 34 experiences an extreme over-pressure, the diaphragm 34 will deflect a distance equal to the traveling distance $D_t$ where the stop 58 engages the roof 60. This engagement prevents further deflection of the diaphragm 34 and reduces the risk of diaphragm material failure.

In the preferred embodiment, the stop 58 is integral with the support member 38. This integral assembly can be either a homogenous one as illustrated in FIGS. 1 and 2 or the stop may be formed separately from the support member such as by stamping from a metal sheet or molding from plastic a cup and fastening the stop to the support member.

In the preferred embodiment, the stop 58 extends inside of the coils of the spring 22. This provides for a compact arrangement that also prevents uneven loading on the spring 22 or the diaphragm assembly 20.

As shown in FIG. 2, due to the tolerance stack-up of at least the length of the fuel outlet 16, the spring rate of the coil spring 22, the length of the can housing member 26 and the length of the stop 58, the traveling distance $D_t$ between the end face of the stop and the roof 60 of the can housing member 26 is preferably at least equal to approximately this tolerance stack-up. Also, the preferred value of the traveling distance $D_t$ is substantially greater than the opening distance $D_o$ needed to unseat the valve closing member 48 from the valve seat 24 and permit fuel to flow into the fuel passage 53. This ensures that the stop 58 does not prematurely engage the roof 60 to prevent the valve closing member 48 from opening the fuel outlet 16 a sufficient amount to evacuate the excess fuel. The opening distance $D_o$ is dependent on the diameter of the fuel passage 53. In the preferred embodiment, the diameter of the fuel passage 53 is approximately 2–4 mm, the opening distance $D_o$ is approximately 0.1–0.1 mm and the traveling distance $D_t$ is approximately 3–6 mm. The traveling distance $D_t$ should be chosen to be less than the maximum elastic elongation of the diaphragm 34 determined by its yield strength. It is preferred that the fully compressed height of the spring 22 should be less than the travel distance $D_t$ to ensure that the stop 58 can engage the roof 60.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What we claim is:

1. A fuel pressure regulator for use with an internal combustion engine, the fuel pressure regulator comprising:

a housing including:

an inner surface;

an inlet;

an outlet including a seat; and a longitudinal axis;

a valve assembly in the housing intermediate the inlet and the outlet and electively opening fluid communication between the inlet and the outlet when a fuel pressure at the inlet is at least equal to an over-pressure amount, the valve assembly including:

a support member including a recess and a bore extending from the recess;

a closure member movably mounted in the recess; and a first spring mounted in the bore and contacting the bore and the closure member;

an elastic diaphragm connecting the valve assembly to the housing, the diaphragm being in fluid communication with the inlet and elastically displaceable along the longitudinal axis up to a maximum distance;

the valve assembly being displaceable along the longitudinal axis by an opening distance when a fuel pressure at least equal to the over-pressure amount acts on the diaphragm so that the diaphragm does not exceed its yield strength;

a stop extending from the valve assembly and having an end face, spaced from the inner surface of the housing along the longitudinal axis by a traveling distance when the valve assembly closes the fluid communication between the inlet and the outlet;

the traveling distance being at most equal to the maximum distance and substantially greater than the opening distance; and a second spring having a first end contacting the inner surface of the housing and a second end contacting the valve assembly, the second spring biasing the valve assembly to close the fluid communication between the inlet and the outlet when the fuel pressure at the inlet is less than the over-pressure amount.

2. The fuel pressure regulator according to claim 1, wherein the housing, the outlet, the spring and the stop each including a length tolerance measured along the longitudinal axis; and the traveling distance being approximately equal to the sum of the length tolerances of the housing, the outlet, the spring and the stop.

3. The fuel pressure regulator according to claim 2, wherein the diaphragm and the valve assembly together divide the housing into upper and lower sections along the longitudinal axis;

the lower section having a volume of at least approximately 1100 $mm^3$; and the over-pressure amount being at least approximately 800 kPa.

4. The fuel pressure regulator according to claim 2, wherein the stop being displaceable by an amount equal to the traveling distance when a second fuel pressure greater than the over-pressure amount acts on the diaphragm; and the stop being engaged with the other of the housing and the support when the stop is displaced a distance equal to the traveling distance.

5. The fuel pressure regulator according to claim 4, wherein the closure member biased into sealing engagement with the seat by the first and second springs to close the fluid communication between the inlet and the outlet.

6. The fuel pressure regulator according to claim 5, wherein the spring being a coil spring having a fully compressed height measured along the longitudinal axis the fully compressed height being less than the traveling distance and the spring extending between the inner surface and the support.

7. The fuel pressure regulator according to claim 6, wherein the stop is integrally formed on the support and centered about the longitudinal axis; and the coil spring surrounds the stop.

8. The fuel pressure regulator according to claim 5, wherein the support and the diaphragm together divide the housing into the upper and lower sections;

the stop being located in the upper section; and the closure member and the seat being located in the lower section.

9. A method of assembling a fuel pressure regulator for use with an internal combustion engine, the method comprising:

providing a housing including:

an inlet; and an outlet;

a valve seat intermediate the inlet and the outlet, the valve seat fluidly connecting the inlet to the outlet;

a support movable inside the housing;

a valve connected to the support and matingly engageable with the valve seat to shut off the fluid connection between the inlet and the outlet provided by the valve seat; and a diaphragm attached to the support and to the housing, the diaphragm being resiliently displaceable up to a maximum distance; and a compression spring adjacent the stop, the spring biasing the valve into mating engagement with the valve seat and permitting the valve to separate from the valve seat by an opening distance to fluidly connect the inlet and the outlet;

a stop on one of the housing and the support, the stop being engagable with the other of the housing and the support;

providing each of the housing, the outlet, the compression spring and the stop with a length tolerance; and spacing the stop from the housing by a traveling distance approximately equal to the sum of the length tolerances of the housing, the outlet, the compression spring and the stop such that traveling distance including a distance having an order of magnitude greater than the opening distance.

10. The method according to claim 9, wherein the stop of providing the compression spring including:

selecting a spring constant for the compression spring to permit a first fuel pressure at least equal to the over-pressure amount acting on the diaphragm to displace the valve away from engagement with the valve seat by the opening distance;

the traveling distance including a distance of approximately 3–6 millimeters and the opening distance including a distance of approximately 0.1 millimeters.

11. The method according to claim 9, wherein the step of providing the compression further includes:

selecting the spring constant for the compression spring to permit a second fuel pressure greater than the over-pressure amount acting on the diaphragm to displace the diaphragm a distance equal to the traveling distance;

wherein the stop engages the housing when the diaphragm is displaced a distance equal to the traveling distance.

12. A fuel pressure regulator for use with an internal combustion engine, the fuel pressure regulator comprising:

a housing including:

an inlet;

an outlet; and a longitudinal axis;

the housing having a total length measured along the longitudinal axis of approximately 30–40 mm;

a valve assembly in the housing intermediate the inlet and the outlet and being displaceable along the longitudinal axis by an opening distance to selectively open fluid communication between the inlet and the outlet when a fuel pressure at the inlet is at least equal to 500 kPa;

an elastic diaphragm connecting the valve assembly to the housing, the diaphragm being elastically displaced along the longitudinal axis to a maximum distance; and a stop extending along the longitudinal axis from the valve assembly toward the housing, the stop being spaced from the housing by a traveling distance measured along the longitudinal axis, the traveling distance including a distance having an order of magnitude greater than the opening distance, the traveling distance being equal to at least the sum of length tolerances of the housing, the outlet and the stop.

13. The fuel pressure regulator according to claim 12, wherein the valve assembly includes a spring extending between the housing and the valve assembly to bias the valve assembly to close the fluid communication between the inlet and the outlet when the fuel pressure at the inlet is less than 500 kPa, the spring has a spring constant of at least 6.9 N/m.

14. The fuel pressure regulator according to claim 1, wherein the housing further comprises a metal housing.

15. The fuel pressure regulator of claim 12, wherein the traveling distance being at most equal to the maximum distance.

16. The fuel pressure regulator of claim 13, wherein the spring comprises a coil spring.

* * * * *